US005682615A

United States Patent [19]

Wahl et al.

[11] Patent Number: 5,682,615

[45] Date of Patent: Nov. 4, 1997

[54] DECORATIVE HAT HAVING A MINIATURE SPORTING DISPLAY

[76] Inventors: Barbara Wahl, 6634 State Rd., Apt. 191, Dodgeville, Wis. 53533; Lisa Keast, 309 Scott St., R.R. 2, Mazomanie, Wis. 53560

[21] Appl. No.: 710,372

[22] Filed: Sep. 16, 1996

[51] Int. Cl.[6] ..... A42C 5/00

[52] U.S. Cl. ..... 2/209.13; 2/175.3; D2/895

[58] Field of Search ..... 2/209.13, 175.3, 2/244; D2/866, 868, 869, 891, 895; 446/27

[56] References Cited

U.S. PATENT DOCUMENTS

| | | |
|---|---|---|
| D. 285,141 | 8/1986 | Whisman . |
| D. 287,061 | 12/1986 | Bound . |
| 1,776,175 | 9/1930 | Wittekind . |
| 2,679,711 | 6/1954 | Learnard . |
| 3,104,644 | 9/1963 | Burton . |
| 3,106,184 | 10/1963 | Shea . |
| 4,747,164 | 5/1988 | Foulke . |
| 4,881,654 | 11/1989 | Stazo et al. . |
| 5,530,970 | 7/1996 | Knutson . |

FOREIGN PATENT DOCUMENTS

| | | |
|---|---|---|
| 444667 | 3/1936 | United Kingdom . |
| WO92/20247 | 11/1992 | WIPO . |

*Primary Examiner*—Diana Biefeld
*Attorney, Agent, or Firm*—Richard C. Litman

[57] ABSTRACT

A soft decorative hat includes a miniature sporting display device that is disposed on the top portion of the crown of the hat. The sporting display device has two goalposts spaced apart and one of the goalposts is slightly higher than the other. The higher goalpost bears a pennant decorative attachment. Further, the sporting display device has a crossbar connecting the two goalposts.

4 Claims, 1 Drawing Sheet

DECORATIVE HAT HAVING A MINIATURE SPORTING DISPLAY

BACKGROUND OF THE INVENTION

1. Field of the Invention

The present invention relates generally to a decorative hat having a miniature sporting display thereon. More specifically, the invention relates to a soft novelty hat that includes a miniature goalpost display having a pennant-like decorative attachment.

2. Description of Prior Art

Headwear, such as hats, caps and headbands, has been used in the past as a site for attaching a device for display or other use on or about the wearer's head, as exemplified by the following patents.

U.S. Pat. No. 285,141, issued on Aug. 19, 1986 to Whisman, shows an ornamental design for a combined cap and ball glove. U.S. Pat. No. 287,061, issued on Dec. 9, 1986 to Bound, shows an ornamental design for a combined helmet and beverage container supports. U.S. Pat. No. 1,776,175, issued on Sep. 16, 1930 to Wittekind, discloses a headgear having spinning propeller thereon. U.S. Pat. No. 2,679,711, issued on Jun. 1, 1954 to Learnard, discloses an Indian headdress with whirling feathers. U.S. Pat. No. 3,104,644, issued on Sep. 24, 1963 to Burton discloses a water skier safety device including a cap and a flag attachment. The flag has a pole or stem which may be screwed into the back portion of the cap. U.S. Pat. No. 3,106,184, issued on Oct. 8, 1963 to Shea, discloses a safety cap used by water skiers. A pole bearing a pennant-like attachment is vertically disposed at the top of the hat. U.S. Pat. No. 4,747,164, issued on May 31, 1988 to Foulke, discloses a novelty hat including pop-up decorative shapes arranged around the open crown portion. U.S. Pat. No. 4,881,654, issued on Nov. 21, 1989 to Stazo et al., discloses a cap having a fishing tackle box thereon. U.S. Pat. No. 5,530,970, issued on Jul. 2, 1996, discloses a cap having a coil spring display thereon. United Kingdom Patent Document No. 444,667, dated Mar. 25, 1936 to Belzer, discloses a cap having warning devices thereon. PCT Patent Document No. WO92/20247, dated Nov. 26, 1992 to Power-Fardy, discloses a powered display on a headwear having movable parts for displaying a symbol. None of the above patents disclose a soft decorative hat that includes a miniature goalpost display device having a pennant-like decorative attachment, as defined by the present invention.

None of the above inventions and patents, taken either singly or in combination, is seen to describe the instant invention as claimed.

SUMMARY OF THE INVENTION

The present invention relates to a soft decorative hat which includes a miniature sporting display device that is disposed on the top portion of the crown of the hat. The sporting display device has two goalposts spaced apart and one of the goalposts is slightly higher than the other. The higher goalpost bears a pennant-like decorative attachment. Further, the sporting display device has a crossbar connecting the two goalposts.

Accordingly, it is a principal object of the invention to provide a novelty hat that includes a miniature sporting display device disposed on the top portion of the hat's crown.

It is another object of the invention to provide a decorative hat that includes a miniature goalpost display disposed on the top portion of the hat's crown, such a display making an attractive and/or amusing novelty hat item for wearing at a sporting event.

It is further object of the invention to provide an attractive decorative hat that includes a miniature sporting display disposed on the top portion of the hat's crown, such a display making an attractive and/or amusing novelty item of merchandise.

Still another object of the invention is to provide a decorative hat having a miniature sporting display disposed on the top portion of the hat's crown, which hat is economical to manufacture.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawing.

BRIEF DESCRIPTION OF THE DRAWING

Similar reference characters denote corresponding features consistently throughout the attached drawing.

DETAILED DESCRIPTION OF THE PREFERRED EMBODIMENTS

Figure 1:
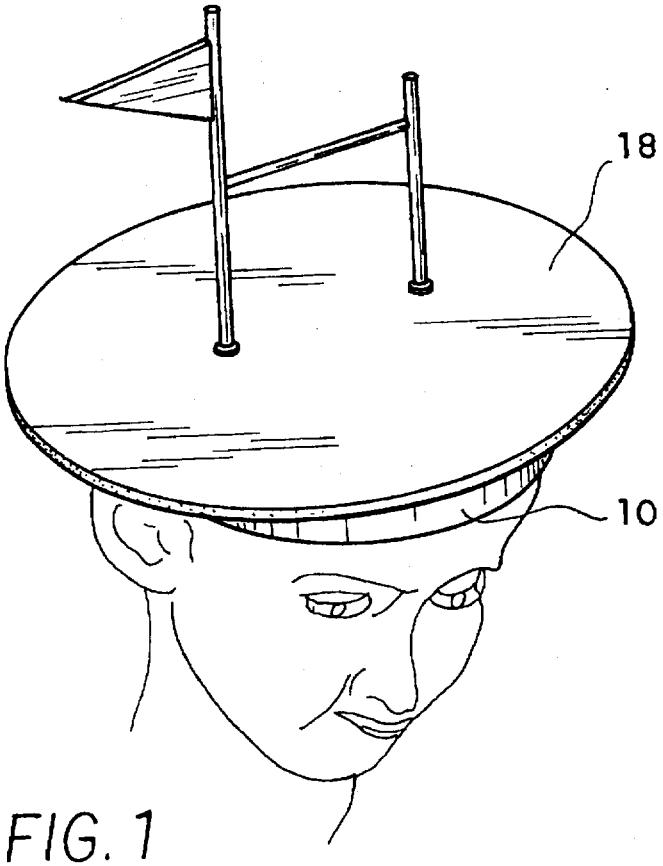
FIG. 1 is a front environmental perspective view of the decorative hat having a miniature goalpost display, according to the present invention.
Figure 2:
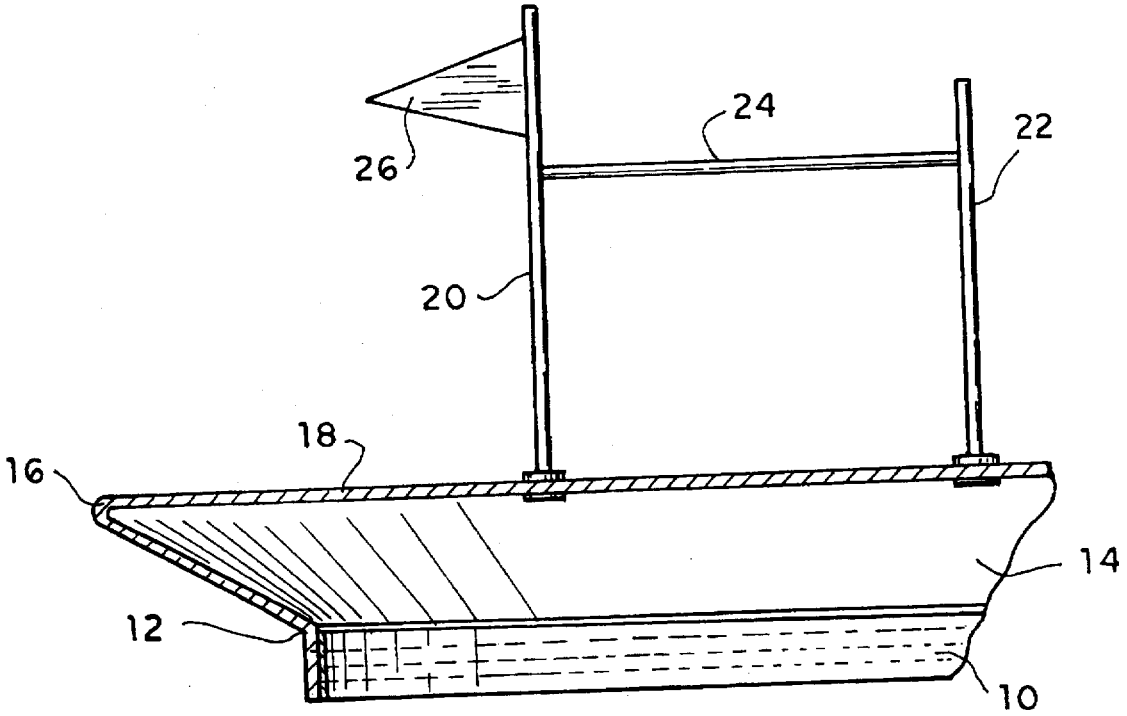
FIG. 2 is a partial cross-sectional view of the hat shown in FIG. 1, and drawn to an enlarged scale.

In the drawing figures, there is illustrated a hat that includes a cylindrical-shaped band portion 10 having an open top and an open bottom. The band portion 10 has a top peripheral edge 12. An inclined flange portion 14 extends upwardly and outwardly from to the top peripheral edge 12. The flange portion 14 has a top peripheral edge 16. A circular-shaped substantially flat crown portion 18 is attached to the top peripheral edge 16 of the flange portion 14. A miniature sporting display device is dimensioned and configured for positioning on the crown portion 18 and is affixed thereto. The display device includes a first vertical goalpost 20 and a second vertical goalpost 22 which is spaced a predetermined distance apart from the first vertical goalpost 20. Further, the display device includes a horizontal crossbar 24 which is shown attached near the top of the goalposts 20, 22 or could be, for example, at substantially the median point of each of the goalposts 20, 22, respectively. The first vertical post 20 is slightly longer than the second vertical goalpost 22. The first vertical goalpost 20 has a free end. A pennant 26, which is a flag tapering along its length to a point at its free end, is attached along its width to the free end of the first vertical goalpost 20. Accordingly. in the instant invention, the miniature sporting display device on the hat can constitutes a decorative item for wearing at a sporting event and the like.

The hat may be made in a full range of head sizes. The hat may be made of a soft felt-like flexible material. Or the hat could be fabricated from a single sheet of stock material, for example, a plastic material. The miniature goalpost display device may be made of thin plastic rods to provide resilience to the device.

Prototypes of the instant hat invention have the following dimensional range of inch values:

the width of the band portion is from 1 in. to 3 in.;

the diameter of the band portion is from 2 in. to 10 in.;

the diameter of the crown portion is from 3 in. to 20 in.;

the length of the first post is from 4 in. to 8 in.;

the length of the horizontal crossbar is from 2 in. to 5 in.;

the length of the second post is from 3 in. to 6 in.;

the width of the pennant item is from 1 in. to 3 in. and and the length of the pennant item is from 1 in. to 6 in.

Various modifications may be made to the present invention. For example, the scope of the invention is not restricted to the disclosed hat structure, but obviously may include a cap structure and other types of headgear.

It is to be understood that the present invention is not limited to the embodiments described above, but encompasses any and all embodiments within the scope of the following claims.

We claim:

1. A hat, comprising:

a band portion having an open top and an open bottom, said band portion having a top edge;

an inclined flange portion which extends upwardly and outwardly from the top edge of the band portion, said flange portion having a top edge;

a substantially flat crown portion attached across said top edge of said flange portion; and a miniature sporting display device being dimensioned and configured for positioning on said crown portion and being affixed thereto, said display device including:

a first post member;

a second post member being spaced a predetermined distance apart from said first post member;

a crossbar member being attached to each of said first and second post members, respectively;

said first post member having a slightly longer length than said second post member;

a pennant item being attached to go said first post member;

whereby the hat having said miniature sporting display device constitutes a decorative item for wearing at a sporting event.

2. The hat according to claim 1, wherein said hat is made of a soft felt-like material.

3. A hat, comprising:

a cylindrical-shaped band portion having an open top and an open bottom; said band portion having a top peripheral edge;

an inclined flange portion which extends upwardly and outwardly from said top peripheral edge of the band portion, said flange portion having a top peripheral edge;

a circular-shaped substantially flat crown portion attached across said top peripheral edge of said flange portion; and a miniature sporting display device being dimensioned and configured for positioning on said crown portion and being affixed thereto; said display device including:

a first vertical goalpost member;

a second vertical goalpost member being spaced a predetermined distance from said first vertical goalpost;

a horizontal crossbar member being attached at substantially the median point of each of said first and second vertical goalpost members, respectively;

said first vertical post member being slightly longer in length than said second vertical goalpost member; said first vertical goalpost member having a free end;

a pennant member being attached to said free end of said first vertical goalpost member;

whereby the hat having said miniature sporting display device constitutes a decorative item for wearing at a sporting event.

4. The hat according to claim 3, wherein said hat is made of a soft felt-like flexible material.

* * * * *